US007946854B2

(12) United States Patent
Weidner et al.

(10) Patent No.: US 7,946,854 B2
(45) Date of Patent: May 24, 2011

(54) ELECTRICAL CONNECTOR ASSEMBLY HAVING SHIELD MEMBER

(75) Inventors: Kevin Weidner, Hummelstown, PA (US); Jeffrey K. Orner, Boiling Springs, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/506,868

(22) Filed: Jul. 21, 2009

(65) Prior Publication Data

US 2011/0021042 A1 Jan. 27, 2011

(51) Int. Cl.
*H01R 12/00* (2006.01)

(52) U.S. Cl. ..... 439/63; 439/581

(58) Field of Classification Search ..... 439/59, 439/63, 92, 95, 708, 181, 581, 620.03, 620.15, 439/620.16, 607.04, 607.27, 607.28, 607.31, 439/607.32, 607.34–607.36, 607.41
See application file for complete search history.

(56) References Cited

U.S. PATENT DOCUMENTS 4,640,979 A 2/1987 Schmalzl
4,762,966 A 8/1988 Kosanda
4,795,352 A 1/1989 Capp et al.
4,803,306 A 2/1989 Malmquist
4,884,982 A * 12/1989 Fleming et al. ..... 439/620.03
4,934,960 A 6/1990 Capp et al.
5,029,254 A 7/1991 Stickney
5,062,811 A 11/1991 Hackman
5,108,300 A * 4/1992 Weber ..... 439/188
5,233,507 A 8/1993 Günther et al.
5,326,280 A 7/1994 Briones et al.
5,478,258 A * 12/1995 Wang ..... 439/581
5,722,837 A * 3/1998 Kurahashi ..... 439/63
6,036,545 A * 3/2000 Caviness et al. ..... 439/620.1
6,116,924 A * 9/2000 Laut ..... 439/95
6,120,304 A 9/2000 Harwood et al.
6,238,218 B1 * 5/2001 Baffert ..... 439/63
6,320,120 B1 11/2001 Van Haaster
6,469,255 B2 * 10/2002 Watanabe et al. ..... 174/254
6,676,137 B2 1/2004 Dean
7,014,480 B1 * 3/2006 Weidner et al. ..... 439/95
7,042,318 B2 5/2006 Barnes et al.
7,234,967 B2 * 6/2007 Weidner et al. ..... 439/581
7,500,855 B2 * 3/2009 Kari ..... 439/63
7,713,067 B1 * 5/2010 Behrent ..... 439/63
7,731,512 B1 * 6/2010 Montena et al. ..... 439/108

* cited by examiner

*Primary Examiner* — Thanh-Tam T Le

(57) ABSTRACT

An electrical connector assembly includes a coaxial connector structure having a center contact configured to be surface mounted to an upper surface of a circuit board at a board edge of the circuit board. The center contact extends along a contact axis in an axial direction. A shielded housing block extends rearward from the coaxial connector structure. The shielded housing block has a shielded chamber receiving a portion of the center contact with an open bottom extending along the upper surface of the circuit board. A shield member engages at least one of the coaxial connector structure and the shielded housing block. The shield member extends along at least a portion of the open bottom of the shielded chamber in the axial direction.

22 Claims, 6 Drawing Sheets

ELECTRICAL CONNECTOR ASSEMBLY HAVING SHIELD MEMBER

BACKGROUND OF THE INVENTION

The subject matter herein relates generally to electrical connectors, and more particularly to electromagnetic interference (EMS) shielding for electrical connectors.

High-frequency connectors are used to bring high frequency signals, such as radio frequency (RF) signals, on and off of a printed circuit board. One type of such connectors are coaxial connectors having a center contact that is mounted directly to the circuit boards. The coaxial connectors have a coaxial connector interface on one end, with the center contact connected to the printed circuit board on the other end. A variety of types of coaxial connector standards are known and in widespread use, such as SMA, SMB, SMC, SSMA, 3.5-mm, 2.4-mm, and 1.85-mm standards. Coaxial cables with a mating coaxial interface are connected to the coaxial connector interface of the coaxial connectors.

The connectors are typically either right-angle connectors, vertical connectors or edge launched connectors. All styles have advantages and disadvantages. The edge launched connectors and vertical connectors are capable of higher performance as compared to the right angle connectors because the center contact of the edge launched connectors is straight, whereas, the center contact of the right angle connectors is bent at 90°. Furthermore, the edge launched connectors are typically lower profile than the right angle connectors and the vertical connectors. Moreover, the center contact of the edge launched connectors may be electrically connected to the circuit board using reflow soldering as opposed to wave soldering, which may reduce costs and provide a more reliable connection. Additionally, edge launched connectors may be secured to the circuit board more easily than right angle connectors, such as without the use of secondary securing features. However, the right angle connectors are able to better shield the center contact as compared to the edge launched connectors because the edge launched connectors have an open housing along the mounting surface of the circuit board, and gaps are often present between the point where the center contact exits the connector and passes onto the surface plane of the circuit board. Proper shielding of edge launched connectors has proven difficult.

A need remains for an edge launch connector with improved electrical characteristics. A need remains for an edge launched connector with shielding from unwanted interference.

BRIEF DESCRIPTION OF THE INVENTION

In one embodiment, an electrical connector assembly is provided that includes a coaxial connector structure having a center contact configured to be surface mounted to an upper surface of a circuit board at a board edge of the circuit board. The center contact extends along a contact axis in an axial direction. A shielded housing block extends rearward from the coaxial connector structure. The shielded housing block has a shielded chamber receiving a portion of the center contact with an open bottom extending along the upper surface of the circuit board. A shield member engages at least one of the coaxial connector structure and the shielded housing block. The shield member extends along at least a portion of the open bottom of the shielded chamber in the axial direction.

In another embodiment, an electrical connector assembly is provided including a shielded housing having a front housing body and a rear housing body. The rear housing body is configured to be coupled to an upper surface of a circuit board at a board edge of the circuit board. The rear housing body defines a shielded chamber having an open bottom. The housing also includes an intermediate body at the transition between the front housing body and the rear housing body. The intermediate body having a rear facing shoulder that faces the board edge of the circuit board when the housing is coupled to the circuit board. A center contact is held by the housing and extends axially along a contact axis between a mating end and a mounting end. The mating end is arranged in the front housing body and the mounting end is arranged in the shielded chamber generally coplanar with the open bottom. The mounting end is configured to be electrically connected to the upper surface of the circuit board when the housing is coupled to the circuit board. A shield member engages the intermediate body of the housing and extends rearward from the rear facing shoulder of the intermediate body.

In a further embodiment, an electrical connector assembly is provided that includes a shielded housing configured to be coupled to a board edge of a circuit board. The shielded housing has a rear housing body defining a shielded chamber having an open bottom that is mounted to an upper surface of the circuit board. The housing includes an intermediate body having a rear facing shoulder extending forward of, and facing, the board edge of the circuit board when the housing is coupled to the circuit board. A center contact is held by the housing in the shielded chamber generally coplanar with the open bottom. The center contact is configured to be electrically connected to the upper surface of the circuit board when the housing is coupled to the circuit board. A shield member engages the intermediate body of the housing and extends rearward from the rear facing shoulder of the intermediate body across the space between the rear facing surface and the board edge of the circuit board.

DETAILED DESCRIPTION OF THE INVENTION

Figure 1:
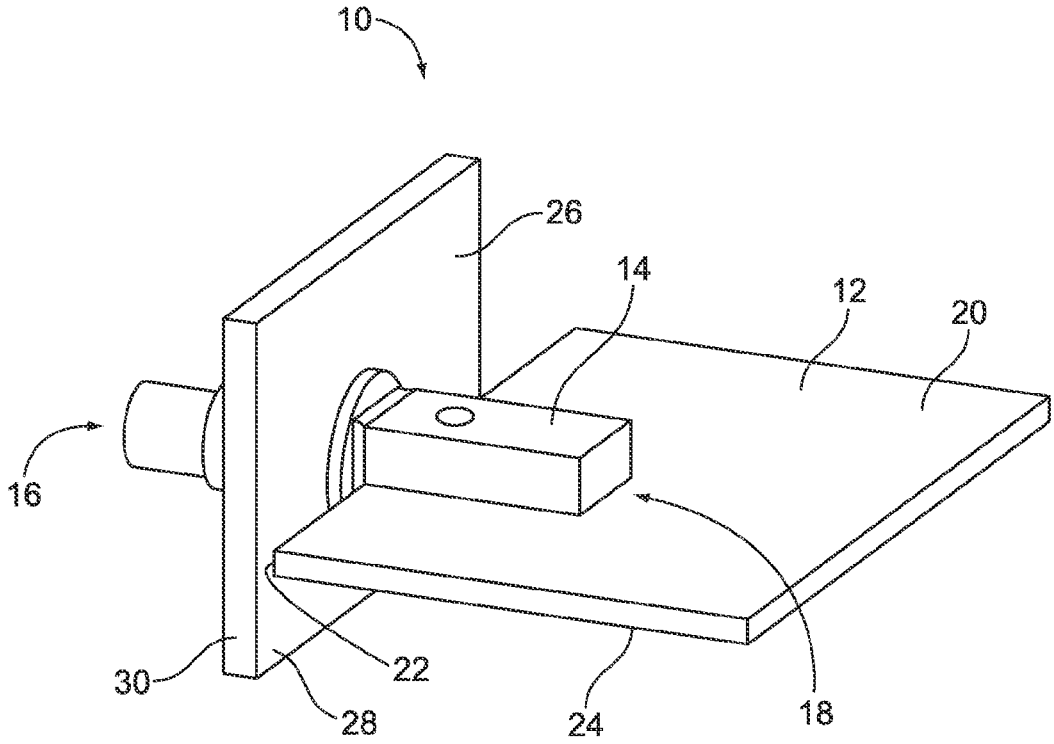
FIG. 1 illustrates an edge launched connector assembly.

FIG. 1 illustrates an electrical connector assembly 10 for interconnecting a coaxial cable connector (not shown) with circuitry of a printed circuit board 12. The electrical connector assembly 10 includes an electrical connector 14 and a shield member 100 (shown in FIG. 3) used for shielding a portion of the electrical connector 14. The electrical connector 14 includes a coaxial connector interface 16 and a circuit board interface 18. The coaxial connector interface 16 is provided at a front of the electrical connector 14 for mating with the coaxial cable connector. The circuit board interface 18 is provided at a rear of the electrical connector 14 for mounting to an upper surface 20 of the circuit board 12.

In the illustrated embodiment, the electrical connector 14 represents an edge launched connector extending from a board edge 22 of the circuit board 12. The board edge 22 is oriented perpendicular to the upper surface 20 of the circuit board 12. The board edge 22 extends between the upper surface 20, which may represent a top surface of the circuit board 12, and a bottom surface 24 of the circuit board 12. The circuit board 12 has a thickness between the upper surface 20 and the bottom surface 24. As an edge launched connector, the electrical connector 14 is positioned generally coplanar with the plane defined by the circuit board 12, and forward of the board edge 22. For example, a portion of the electrical connector 14 is arranged vertically above the plane of the circuit board 12 and a portion of the electrical connector 14 is arranged vertically below the plane of the circuit board 12.

Only a portion of the circuit board 12 is illustrated in FIG. 1. The circuit board 12 may be of any size and may include any number of electrical connectors 14 and/or other electrical components. The electrical connector 14 may be interconnected with the electrical components or other electrical connectors 14 by circuitry of the circuit board 12.

The electrical connector 14 extends through a panel 26. The circuit board 12 and the circuit board interface 18 of the electrical connector 14 are arranged behind a rear surface 28 of the panel 26. As such, the circuit board 12 may be housed internal to an electronic device, such as a computer. The coaxial connector interface 16 of the electrical connector 14 is arranged in front of a front surface 30 of the panel 26. As such, the coaxial connector interface 16 is external to the electronic device for mating with the coaxial cable connector.

Figure 2:
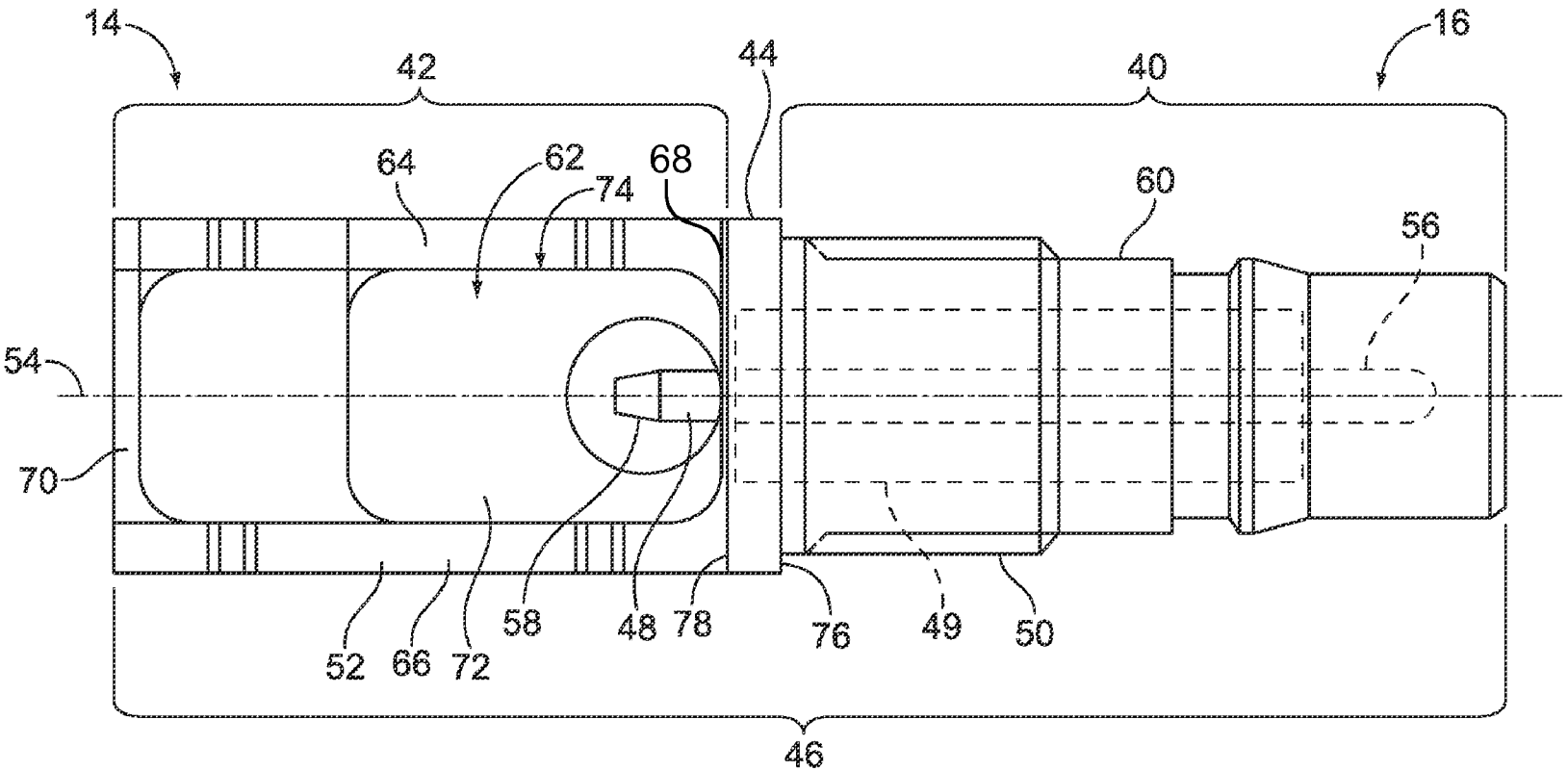
FIG. 2 is a bottom view of an edge launched electrical connector for the assembly shown in FIG. 1.

FIG. 2 is a bottom view of the electrical connector 14. The electrical connector 14 includes a coaxial connector structure 40 at the front of the electrical connector 14 that is configured to mate with the coaxial cable connector. The electrical connector 14 includes a shielded housing block 42 at the rear of the electrical connector 14 that is configured to the mounted to be circuit board 12 (shown in FIG. 1). An intermediate body 44 is arranged between the coaxial connector structure 40 and the shielded housing block 42.

The electrical connector 14 includes a shielded housing 46 that holds, and provides shielding for, a center contact 48. The shielded housing 46 may be at least partially manufactured from a metal material to provide shielding from electrical noise, such as from electromagnetic interference (EMI) or other types of interference that could degrade the signal transmitted along the center contact 48. For example, the shielded housing 46 may be stamped and formed or machined from a metal material. Alternatively, the shielded housing 46 may be manufactured from a metallized plastic material, or a metal plated plastic.

In an exemplary embodiment, the coaxial connector structure 40, the shielded housing block 42, and the intermediate body 44 together define the shielded housing 46. For example, in the illustrated embodiment, the coaxial connector structure 40 includes a front housing body 50 and the shielded housing block 42 includes a rear housing body 52. The intermediate body 44 is positioned at the transition between the front housing body 50 and the rear housing body 52. In an exemplary embodiment, the front housing body 50, the rear housing body 52 and the intermediate body 44 are integrally formed with one another. Alternatively, the front housing body 50 and/or rear housing body 52 may be separate and distinct from the intermediate body 44, and coupled thereto or to one another during an assembly process. The intermediate body 44 may form part of either the coaxial connector structure 40 or the shielded housing block 42. The intermediate body 44 may be positioned remote from either the coaxial connector structure 40 or the shielded housing block 42, such as by having other structures therebetween or by having portions of either the coaxial connector structure 40 or the shielded housing block 42 between the intermediate body 44 and the other of the coaxial connector structure 40 and the shielded housing block 42.

The coaxial connector structure 40 includes the center contact 48, which extends axially along a contact axis 54 between a mating end 56 (shown in phantom) and a mounting end 58. The mating end 56 may be represented by a pin, a socket, or another type of connector interface. The center contact 48 is generally cylindrical between the mating end 56 and the mounting end 58. The coaxial connector structure 40 also includes a dielectric 49 (shown in phantom) that holds the center contact 48. The front housing body 50 circumferentially surrounds the center contact 48 and the dielectric 49 along the contact axis 54. The dielectric 49 electrically isolates the center contact 48 from the front housing body 50.

The front housing body 50 has an outer surface 60 that has a generally circular cross-section. The diameter of the outer surface 60 along the contact axis 54 is variable such that the front housing body 50 includes inwardly stepped and outwardly stepped segments. The outer surface 60 and the center contact 48 cooperate to define the coaxial connector interface 16. For example, the relative sizes and positioning of the outer surface 60 with respect to the center contact 48 may be controlled to define a coaxial connector interface 16 that adheres to a particular coaxial connector standard. Other geometries are possible, including non-circular geometries.

The shielded housing block 42 defines a shielded chamber 62 that receives the mounting end 58 of the center contact 48. The shielded housing block 42 includes the rear housing body 52 having opposed sidewalls 64, 66 that extend between a front 68 and a rear 70 of the rear housing body 52. The rear housing body 52 also includes a top wall 72 and an open bottom 74. The open bottom 74 provides access to the shielded chamber 62 from beneath the shielded housing block 42. The open bottom 74 exposes the center contact 48 and represents the only unshielded portion of the shielded housing 46 along which the center contact 48 is unshielded, and thus susceptible to EMI. The shield member 100 (shown in FIG. 3) is used to shield the open bottom 74. In alternative embodiments, the shielded housing block 42 may have a different shape or orientation relative to the circuit board 12, leaving center contact 48 susceptible to EMI from areas other than the bottom. The shield member 100 (shown in FIG. 3) may be positioned to block EMI from any openings in the shielded housing block 42.

The intermediate body 44 has a front facing shoulder 76 and a rear facing shoulder 78. The coaxial connector structure 40 extends forward from the front facing shoulder 76. The shielded housing block 42 extends rearward from the rear facing shoulder 78. The rear facing shoulder 78 is provided at the front 68 of the rear housing body 52 and at a front of the shielded chamber 62. The center contact 48 extends through the intermediate body 44 into the shielded chamber 62. Optionally, the dielectric 49 may extend at least partially through the intermediate body 44.

Figure 3:
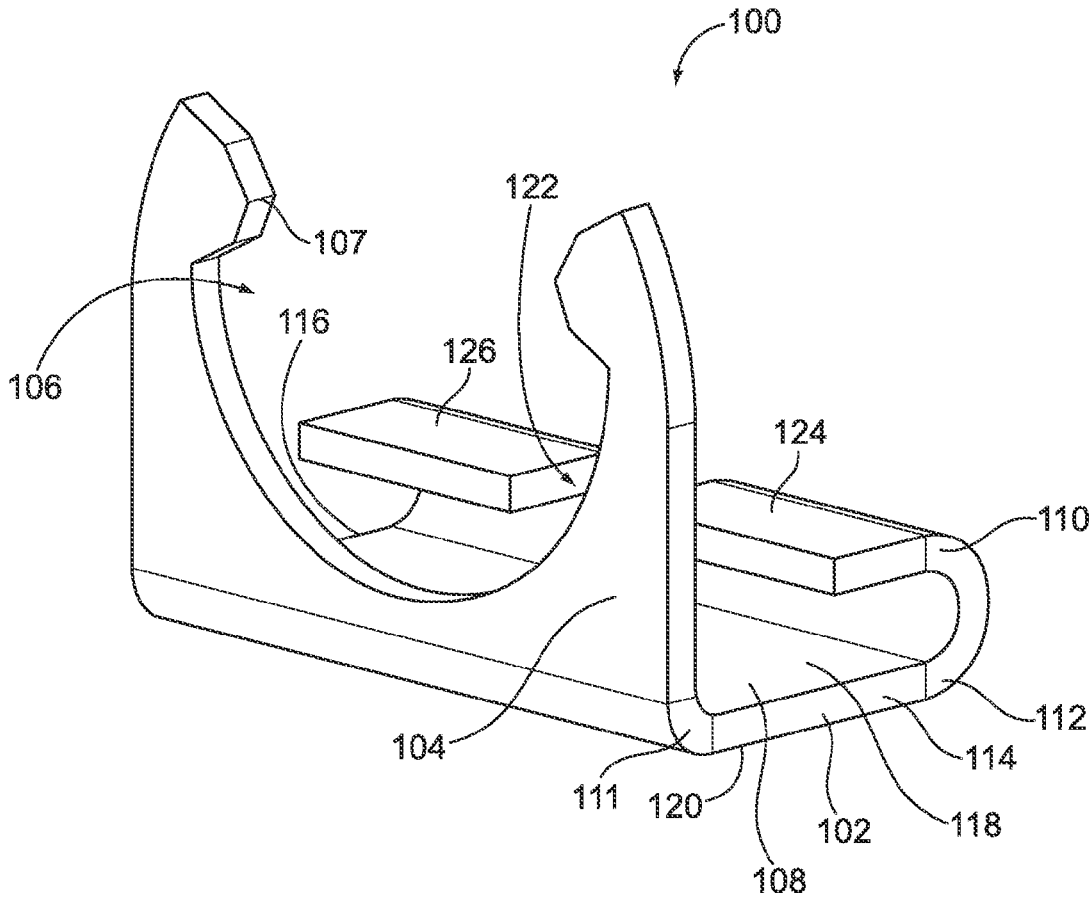
FIG. 3 illustrates a shield member for the electrical connector shown in FIG. 2.

FIG. 3 illustrates a shield member 100 for the electrical connector 14 (shown in FIG. 2). The shield member 100 is used with the electrical connector 14 to provide shielding from EMI and other sources of interference along the open bottom 74 (shown in FIG. 2), as will be described further detail below.

The shield member 100 is manufactured from a metal material. The shield member 100 includes a base 102 and arms 104. The arms 104 extend perpendicular with respect to the base 102. The arms 104 at least partially surrounds an opening 106. The electrical connector 14 fits within the opening 106. In the illustrated embodiment, the opening 106 is generally circular shape, however the opening 106 may have other shapes in alternative embodiments, depending on the particular application and the particular portion of the electrical connector 14 to which the shield member 100 is coupled.

The arms 104 include fingers 107 at the tips thereof. The fingers 107 are used to secure the arms 104 to the electrical connector 14. In an exemplary embodiment, the arms 104 define a C-clip configuration, where the arms 104 clip on to opposite sides of the electrical connector 14 to secure the shield member 100 to the electrical connector 14. The arms 104 may be flexed outward as the electrical connector 14 is loaded into the opening 106, and then the arms 104 may snap into position around the electrical connector 14 to secure the shield member 100 to the electrical connector 14.

In an alternative embodiment, the arms 104 may extend entirely circumferentially around the opening 106. As such, the arms 104 define a ring. The electrical connector 14 may be loaded axially through the opening 106 to position the shield member 100 with respect to the electrical connector 14, as opposed to the shield member 100 clipping onto a surface of the electrical connector 14. Other mounting configurations are possible in alternative embodiments. The shield member 100 may be provided without arms, wherein the shield member 100 is secured to the electrical connector 14 in a different manner.

The base 102 includes a generally planar plate 108 and a wing 110 extending from the plate 108. The plate 108 is a solid block of metal extending between a front 111, a rear 112 and opposite sides 114, 116. The plate 108 has an upper surface 118 and a lower surface 120.

The wing 110 extends upward from the rear 112. In an exemplary embodiment, the wing 110 is folded back over the plate 108 such that the base 102 is generally J-shaped. A portion of the wing 110 may be parallel to, and spaced upward from, the plate 108. The wing 110 may engage the circuit board 12 (shown in FIG. 1) when the shield member 100 is assembled to stabilize the shield member 100. Optionally, the wing 110 may be electrically connected to a grounded circuit of the circuit board 12 to electrically ground the shield member 100. In an exemplary embodiment, the wing 110 includes a notch out 122 defining first and second wing segments 124, 126 that are spaced apart from one another. Optionally, the notch out 122 may be substantially centered on the wing 110.

The shield member 100 may have different shapes and/or features in alternative embodiment. For example, the base 102 may not include a wing or may include more than one wing. The plate 108 may be nonplanar. Many other configurations are possible depending on the particular application. The shield member 100 illustrated in FIG. 3 is merely illustrative of one exemplary embodiment of a shield member 100 for use with the electrical connector 14.

Figure 4:
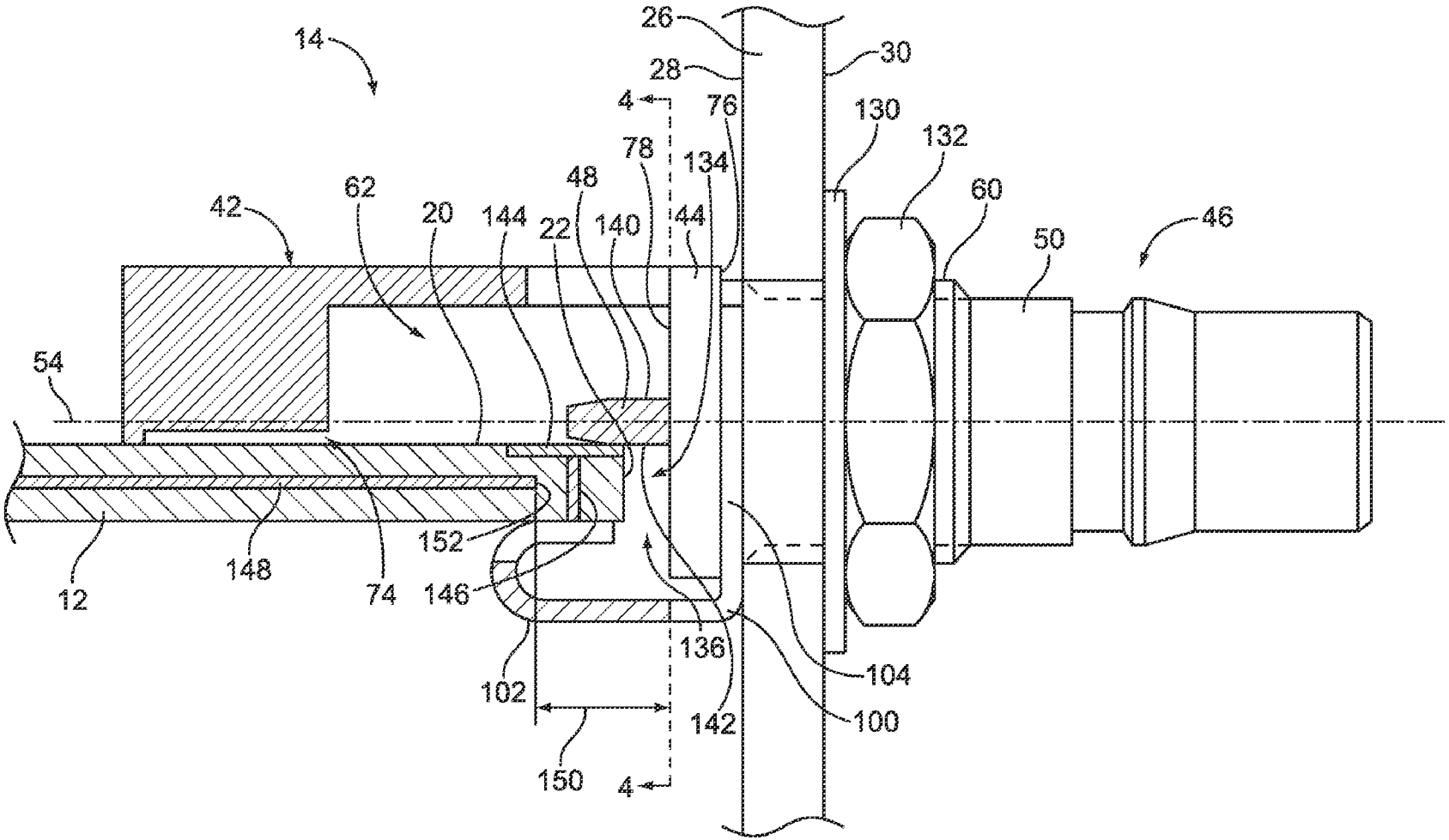
FIG. 4 is a side partial cutaway view of the electrical connector assembly.

FIG. 4 is a side partial cutaway view of the electrical connector 14 mounted to the circuit board 12 and extending through the panel 26. The electrical connector 14 represents an edge launched connector having portions of the electrical connector 14 being coplanar with, and extending forward of, the board edge 22 of the circuit board 12. The electrical connector 14 is generally in line with the circuit board 12 and launches forward from the board edge 22. In the illustrated embodiment, components rearward of line 4-4 are illustrated in cross-section. Line 4-4 is provided along the rear facing shoulder 78, which is oriented generally perpendicular with respect to the contact axis 54.

The electrical connector 14 is secured to the panel 26 using a washer 130 and a nut 132. The nut 132 may be threaded to the outer surface 60 of the front housing body 50. The washer 130 engages the front surface 30 of the panel 26. The shield member 100 engages the rear surface 28 of the panel 26. The panel 26 is sandwiched between the washer 130 and the shield member 100.

The shield member 100 is coupled to the electrical connector 14 such that the arms 104 extend along the front facing shoulder 76 of the intermediate body 44. The shield member 100 is held tight against the front facing shoulder 76 when coupled to the electrical connector 14. When the nut 132 is tightened, the shield member 100 is captured between the intermediate body 44 and the panel 26. The base 102 extends rearward from the arms 104 generally vertically below the shielded chamber 62. The base 102 extends along at least a portion of the open bottom 74 of the shielded chamber 62 in the axial direction, which is parallel to the contact axis 54. The base 102 extends parallel to, and is spaced apart from, the center contact 48 and the open bottom 74 such that a gap 134 exists between the base 102 and the center contact 48. The circuit board 12 is received in the gap 134 when the electrical connector 14 is mounted to the circuit board 12.

When the electrical connector 14 is mounted to the circuit board 12 a space 136 is typically created between the board edge 22 and the rear facing shoulder 78. Such a space 136 is designed to accommodate for manufacturing tolerances of the circuit board 12 and/or the electrical connector 14. The space 136 is small enough that the center contact 48 may span across the space 136 to engage the upper surface 20 of the circuit board 12. The space 136 may be different if a different electrical connector 14 is mounted to the same circuit board 12, or if the same electrical connector 14 is mounted to a different circuit board 12. The space 136 is effectively nonexistent when the circuit board 12 engages the rear facing shoulder 78. The shield member 100 extends rearward from the rear facing shoulder 78 such that the base 102 spans across the space 136 between the rear facing shoulder 78 and the board edge 22. In an exemplary embodiment, the shield member 100 extends along an outer edge of the intermediate body 44 from the front of the intermediate body 44 and then continues rearward from the rear facing surface 78 across the space 136.

The electrical connector 14 is mounted to the upper surface 20 of the circuit board 12. The shielded housing block 42 rests upon the upper surface 20. Optionally, an EMI gasket may be provided between the shielded housing block 42 and the upper surface 20. The open bottom 74 of the shielded housing block 42 is coincident with the upper surface 20 of the circuit board 12. The shielded chamber 62 is thus exposed to the circuit board 12 through the open bottom 74. The center contact 48 extends into the shielded chamber 62 for surface mounting to the circuit board 12. In an exemplary embodiment, the center contact 48 includes a cylindrical outer surface 140. A bottom 142 of the center contact 48 is substantially coplanar with the open bottom 74. As such, when the shielded housing block 42 engages and rests upon the upper surface 20, the bottom 142 of the center contact 48 also engages the upper surface 20. The contact axis 54 is parallel to, and spaced vertically above, the upper surface 20 of the circuit board 12.

The circuit board 12 includes a mounting pad 144 on the upper surface 20. The mounting pad 144 may be part of, or may be electrically connected to a conductive trace routed along or through the circuit board 12. Optionally, a conductive via 146 may be electrically connected to the mounting pad 144. The via 146 extends at least partially through the circuit board 12 generally away from the outer surface 20 in a downward direction through the one or more layers of the circuit board 12. The via 146 transfers signals to and from the mounting pad 144 vertically through the circuit board 12. Optionally, the via 146 may extend entirely through the circuit board 12 such that the via 146 is exposed at the bottom surface 24 of the circuit board 12.

In an exemplary embodiment, the circuit board 12 includes one or more ground planes 148. The ground planes 148 may be defined by one or more layers of the circuit board 12. The ground planes 148 extend parallel to the contact axis 54. The ground planes 148 provide shielding vertically below the shielded housing block 42. The ground planes 148 may or may not extend to the board edge 22. Additionally, the board edge 22 may or may not extend to the rear facing shoulder 78. As such, a shield gap 150 exists between a forward end 152 of the ground plane 148 and the rear facing shoulder 78, or some other rearward most portion of the shielded housing 46 forward of the board edge 22. Without the shield member, the center contact 48 is exposed to EMI through the shield gap 150. However, the shield member 100 spans across the shield gap 150 to shield the center contact 48 from EMI. As such, with the shield member 100 coupled to the electrical connector 14, in addition to the shielded housing 46 and/or the ground planes 148, the center contact 48 is shielded from below along an entire axial length of the center contact 48. Additionally, the shielded housing 46 shields the center contact 48 from above and along the sides of the center contact 48 to provide circumferential shielding for the center contact 48. Optionally, the shield member 100 may overlap the ground planes 148 by a certain amount. Additionally, the ground planes 148 may be positioned vertically below at least a portion of the center contact 48. Optionally, the shield member 100 may be electrically grounded to the ground planes 148.

Figure 5:
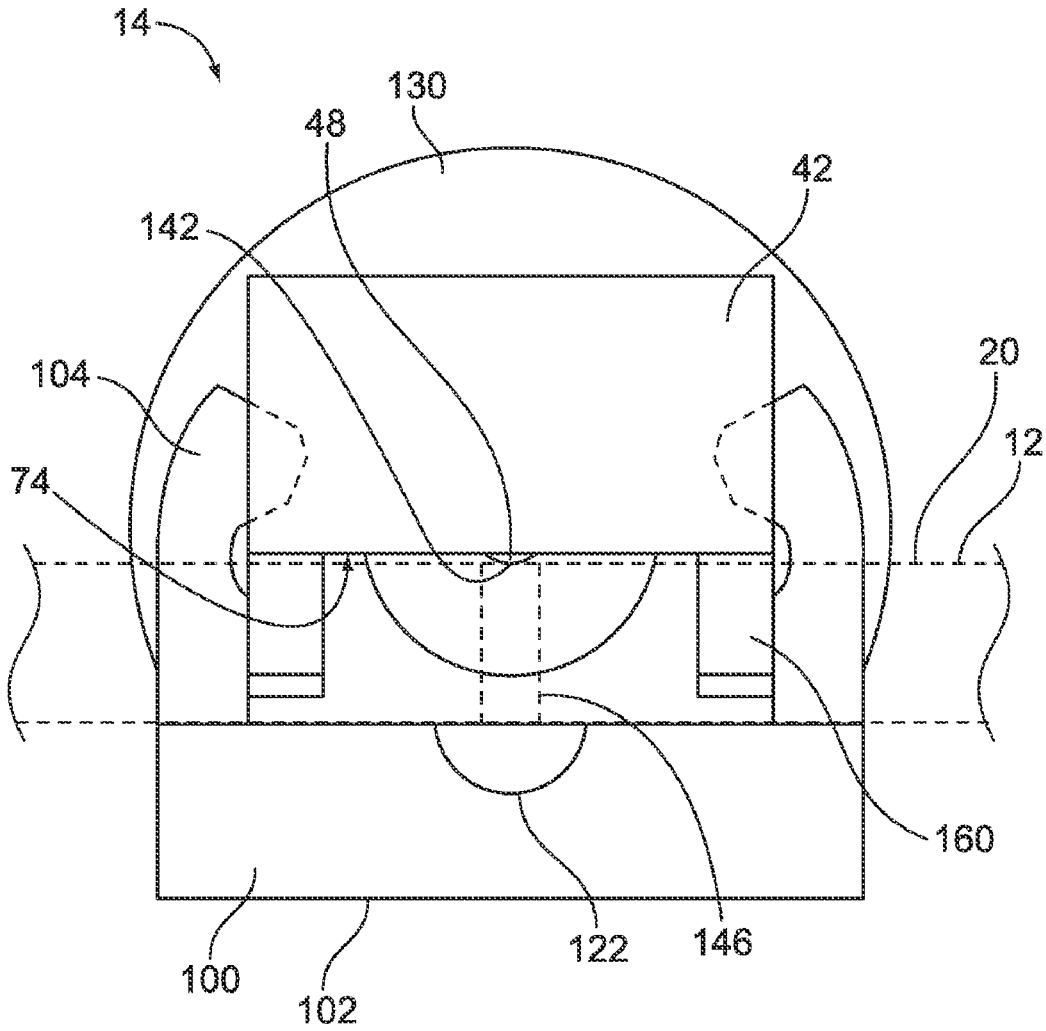
FIG. 5 is a rear view of the electrical connector and shield member.

FIG. 5 is a rear view of the electrical connector 14 and shield member 100 illustrating the circuit board 12 in phantom. The shielded housing block 42 rests upon the upper surface 20 of the circuit board 12. In an exemplary embodiment mounting posts 160 extend downward from the shielded housing block 42 into openings in the circuit board 12. The mounting posts 160 orient the shielded housing block 42 with respect to the circuit board 12. As such, the center contact 48 may be properly positioned on the upper surface 20 of the circuit board 12. FIG. 5 illustrates the bottom 142 of the center contact 48 being substantially coplanar with the open bottom 74 of the shielded housing block 42. Both the bottom 142 and the open bottom 74 are generally coplanar with the upper surface 20.

The shield member 100 is coupled to the electrical connector 14 such that the base 102 covers the open bottom 74 and the bottom 142 of the center contact 48. The shield member 100 shields the center contact 48 from EMI. In an exemplary embodiment, the shield member 100 is wider than the shielded housing block 42 to provide additional shielding from below the sides of the shielded housing block 42. The arms 104 of the shield member 100 extend upward from the base 102 and are positioned rearward of the washer 130. The panel 26 (not shown) may be captured between the washer 130 and the arms 104 of the shield member 100.

In an exemplary embodiment, the circuit board 12 includes the via 146 which extends between the upper surface 20 and the bottom surface 24. The shield member 100 includes the notch out 122 aligned with the via 146. As such, the shield member 100 is spaced apart from, and does not engage the via 146. The shield member 100 is thus not electrically connected to the via 146.

Figure 6:
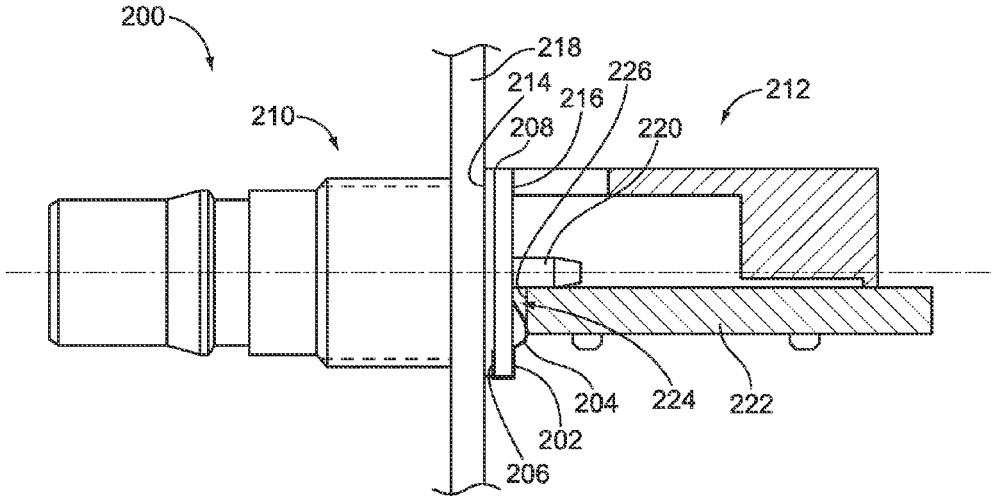
FIG. 6 illustrates an alternative electrical connector assembly.

FIG. 6 illustrates an alternative electrical connector assembly having an electrical connector 200 and a shield member 202. The electrical connector 200 is similar to the electrical connector 14 (shown in FIGS. 1-2 and 4-5). The shield member 202 differs in structure from the shield member 100 (shown in FIG. 3), however the shield member 202 operates in a similar manner.

The shield member 202 includes a base 204 and an arm 206 extending from the base 204. The shield member 202 is coupled to the electrical connector 200 in a different manner than the shield member 100. The arm 206 extends into a slot formed in an intermediate body 208 of the electrical connector 200. Optionally, the intermediate body 208 may be a split body with part of the intermediate body 208 formed integral with a coaxial connector structure 210 and another part of the intermediate body 208 formed integral with a shielded housing block 212. The coaxial connector structure 210 may be coupled to the shielded housing block 212 such that the arm 206 is captured between the two parts of the intermediate body 208.

The intermediate body 208 includes a front facing shoulder 214 and a rear facing shoulder 216. The electrical connector 200 may be coupled to a panel 218 by loading the coaxial connector structure 210 through an opening in the panel 218 from behind the panel 218. The electrical connector 200 is loaded through the panel 218 until the front facing shoulder 214 engages the panel 218. A washer and nut (not shown) may be used to secure the electrical connector 200 to the panel 218 in a similar manner as described above. Other securing means may be used in alternative embodiments, such as fasteners, latches, and the like.

The shielded housing block 212 and a center contact 220 are mounted to a circuit board 222 in a similar manner as described above with the electrical connector 14. When assembled, a space 224 is created between a front board edge 226 and the rear facing shoulder 216. The shield member 202 spans across the space 224. In an exemplary embodiment, the shield member 202 extends into the space 224, rather than spanning below the space 224. The shield member 202 engages both the rear facing surface 216 and the board edge 226. In an exemplary embodiment, the shield member 202 functions as a spring member that may be flexed when the electrical connector 200 is mounted to the circuit board 222. As such, the shield member 202 may fit within differently sized spaces 224.

Figure 7:
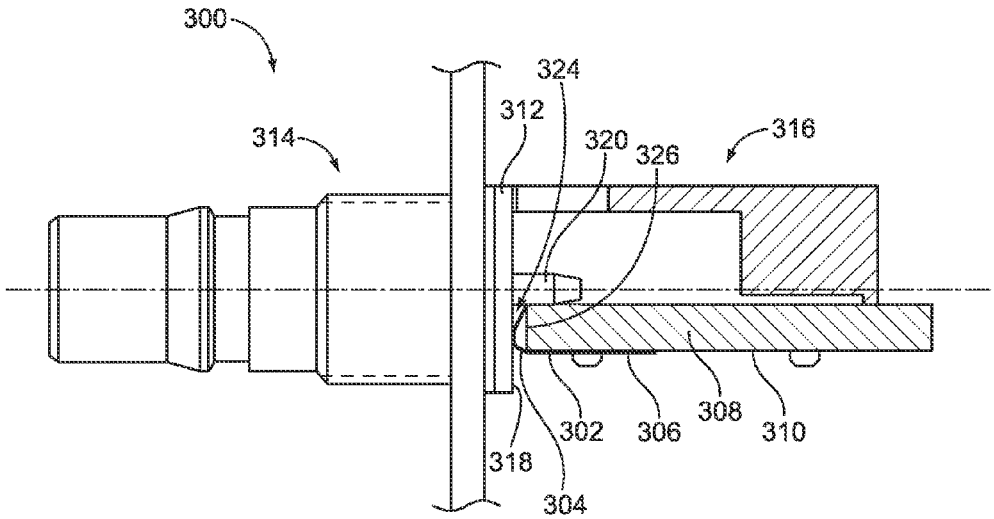
FIG. 7 illustrates another alternative electrical connector assembly.

FIG. 7 illustrates another alternative electrical connector assembly having an electrical connector 300 and a shield member 302. The electrical connector 300 is similar to the electrical connector 14 (shown in FIGS. 1-2 and 4-5). The shield member 302 differs in structure from the shield member 100 (shown in FIG. 3), however the shield member 302 operates in a similar manner.

The shield member 302 includes a base 304 and an arm 306 extending from the base 304. Rather than being coupled to the electrical connector 300, the shield member 302 is coupled to a circuit board 308. The arm 306 extends along a bottom surface 310 of the circuit board 308 and is secured thereto in a conventional manner, such as by using clips, fasteners, an adhesive, and the like.

The electrical connector 300 includes an intermediate body 312 between a coaxial connector structure 314 and a shielded housing block 316. The intermediate body 312 includes a rear facing shoulder 318.

The shielded housing block 316 and a center contact 320 are mounted to the circuit board 308 in a similar manner as described above with the electrical connector 14. When assembled, a space 324 is created between a front board edge 326 and the rear facing shoulder 318. The shield member 302 spans across the space 324. In an exemplary embodiment, the base 304 extends into the space 324, rather than spanning below the space 324. The shield member 302 engages both the rear facing surface 316 and the board edge 326. In an exemplary embodiment, the shield member 302 functions as a spring member that may be flexed when the electrical connector 300 is mounted to the circuit board 308. As such, the shield member 302 may fit within differently sized spaces 324.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a coaxial connector structure having a center contact having a bottom configured to be surface mounted to an upper surface of a circuit board at a board edge of the circuit board, the center contact extending along a contact axis in an axial direction;

a shielded housing block extending rearward from the coaxial connector structure, the shielded housing block having a shielded chamber receiving a portion of the center contact, the shielded chamber having an open bottom extending along the upper surface of the circuit board; and a shield member engaging at least one of the coaxial connector structure and the shielded housing block, the shield member extending along at least a portion of the open bottom of the shielded chamber in the axial direction, the shield member includes a base having a planar plate that is aligned with the center contact, the base being positioned spaced apart from and directly below the bottom of the center contact.

2. The assembly of claim 1, wherein the shielded housing block includes a rear facing shoulder at a front of the shielded chamber, the shielded housing block being positioned with respect to the circuit board such that the rear facing shoulder faces the board edge of the circuit board, the shield member spanning across a space between the rear facing shoulder and the board edge directly below the bottom of the center contact.

3. The assembly of claim 1, wherein the shielded housing block includes a rear facing shoulder at a front of the shielded chamber, the rear facing shoulder extending perpendicular to the contact axis, the circuit board having a ground plane extending parallel to the contact axis, the shielded housing block being positioned with respect to the circuit board such that a shield gap exists between the ground plane and the rear facing shoulder, the shield member spanning across the shield gap directly below the bottom of the center contact.

4. The assembly of claim 1, the planar plate spanning entirely across the open bottom of the shielded chamber, the base extending parallel to, and spaced apart from, the center contact such that a gap exists between the center contact and the base, the gap being configured to receive the circuit board therein.

5. The assembly of claim 1, wherein the shield member has a C-clip configuration with opposing arms that clip to an outer surface of the coaxial connector structure.

6. The assembly of claim 1, wherein the shielded housing block includes an intermediate body having a front facing shoulder, the coaxial connector structure being configured to be mounted to a panel such that the shield member is captured between the front facing shoulder and the panel.

7. The assembly of claim 1, wherein the coaxial connector structure defines an edge launched coaxial connector structure with a portion of the coaxial connector structure being coplanar with, and extending forward of, the board edge.

8. The assembly of claim 1, wherein the center contact includes a cylindrical outer surface, the bottom of the center contact being defined by the outer surface, the bottom being coplanar with the open bottom of the shielded housing block such that the bottom of the center contact and the open bottom rest upon the upper surface of the circuit board.

9. The assembly of claim 1, wherein a space is defined below the open bottom between the shielded housing block and the board edge, the shield member being received within the space to span entirely across the space such that the shield member engages the board edge when the shielded housing block is coupled to the circuit board.

10. The assembly of claim 1, wherein the shield member is configured to be coupled to a bottom surface of the circuit board, the bottom surface of the circuit board being opposite to the upper surface of the circuit board, the shield member extending forward of the board edge to engage the shielded housing block.

11. The assembly of claim 1, wherein the circuit board includes a mounting pad on the upper surface and a via extending into the circuit board from the mounting pad in a downward direction, the center contact being configured to be surface mounted to the mounting pad, the shield member being vertically aligned with respect to the via.

12. The assembly of claim 1, wherein the shield member includes a wing extending from the base, the wing being configured to engage a surface of the circuit board to stabilize the shield member with respect to the circuit board, the wing having a notch out.

13. The assembly of claim 1, wherein the shielded housing block includes a front and a rear, the front being provided at the coaxial connector structure, the rear being positioned rearward of a distal end of the center contact and being closed to define the shielded chamber.

14. The assembly of claim 1, wherein the shield member is separately provided from, and removably coupled to, at least one of the coaxial connector structure and the shielded housing block.

15. An electrical connector assembly comprising:

a shielded housing comprising a front housing body and a rear housing body, the rear housing body being configured to be coupled to an upper surface of a circuit board at a board edge of the circuit board, the rear housing body defining a shielded chamber having an open bottom, the shielded housing comprising an intermediate body at the transition between the front housing body and the rear housing body, the intermediate body having a rear facing shoulder, the rear facing shoulder being configured to face the board edge of the circuit board when the housing is coupled to the circuit board;

a center contact held by the housing, the center contact extending axially along a contact axis between a mating end and a mounting end, the mating end being arranged in the front housing body, the mounting end being arranged in the shielded chamber generally coplanar with the open bottom, the mounting end being configured to be electrically connected to the upper surface of the circuit board when the housing is coupled to the circuit board; and a shield member engaging the intermediate body of the housing and extending rearward from the rear facing shoulder of the intermediate body.

16. The assembly of claim 15, wherein the shield member includes a base extending parallel to, and spaced apart from, the center contact such that a gap exists between the center contact and the base, the gap being configured to receive the circuit board therein.

17. The assembly of claim 15, wherein the shield member spans across a space between the rear facing shoulder and the board edge such that a portion of the shield member extends along the circuit board.

18. The assembly of claim 15, wherein a portion of the intermediate body and the front housing body are coplanar with, and extend forward of, the board edge.

19. The assembly of claim 15, wherein a space is defined below the open bottom between the rear facing shoulder and the board edge, the shield member being received within the space to span entirely across the space such that the shield member engages the board edge when the rear housing body is coupled to the circuit board.

20. An electrical connector assembly comprising:

a shielded housing configured to be coupled to a board edge of a circuit board, the shielded housing having a rear housing body defining a shielded chamber having an open bottom that is mounted to an upper surface of the circuit board, the housing comprising an intermediate body having a rear facing shoulder positioned forward of, and facing, the board edge of the circuit board when the shielded housing is coupled to the circuit board such that a space is created between the rear facing shoulder and the board edge;

a center contact held by the housing in the shielded chamber generally coplanar with the open bottom, the center contact being configured to be electrically connected to the upper surface of the circuit board when the housing is coupled to the circuit board; and a shield member engaging the intermediate body of the housing and extending rearward from the rear facing shoulder of the intermediate body across the space between the rear facing shoulder and the board edge of the circuit board.

21. The assembly of claim 20, wherein the shield member includes a base extending parallel to, and spaced apart from, the center contact such that a gap exists between the center contact and the base, the gap being configured to receive the circuit board therein.

22. The assembly of claim 20, wherein the shield member includes a base and a wing extending from the base, the wing being configured to engage a surface of the circuit board to stabilize the shield member with respect to the circuit board.

* * * * *